US007891202B1

(12) United States Patent
Gallus

(10) Patent No.: US 7,891,202 B1
(45) Date of Patent: Feb. 22, 2011

(54) ABSORPTION SYSTEM

(75) Inventor: Brian T. Gallus, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 12/575,177

(22) Filed: Oct. 7, 2009

(51) Int. Cl.
*F25B 1/00* (2006.01)

(52) U.S. Cl. ..... 62/115; 62/476

(58) Field of Classification Search ..... 62/115, 62/476, 479, 475, 483, 484, 497
See application file for complete search history.

(56) References Cited

U.S. PATENT DOCUMENTS 3,831,393 A * 8/1974 Muench ..... 62/141
4,290,273 A * 9/1981 Meckler ..... 62/148
5,237,839 A * 8/1993 Dehne ..... 62/476
5,253,523 A * 10/1993 Bernardin ..... 62/476
5,584,193 A 12/1996 Biermann
5,592,825 A * 1/1997 Inoue ..... 62/141
5,727,397 A 3/1998 He
5,819,546 A * 10/1998 Uchida ..... 62/141
5,941,089 A * 8/1999 Takaishi et al. ..... 62/324.2
5,941,094 A 8/1999 Tang et al.
6,101,832 A * 8/2000 Franz et al. ..... 62/324.2
6,122,930 A * 9/2000 Nishiguchi et al. ..... 62/476
6,311,513 B1 11/2001 Tang
6,357,254 B1 * 3/2002 Xia ..... 62/476
6,401,465 B1 6/2002 Meinzer
7,464,562 B2 * 12/2008 Inoue et al. ..... 62/324.2

OTHER PUBLICATIONS

York Operating and Maintenance Instructions, "Single-Stage Isoflow Absorption Liquid Chillers", May 11, 2006.
Taimin Tang, Lilia Villarreal, and James Green, "Advanced Design Guideline Series- Absorption Chillers", New Buildings Institute for the Southern California Gas Company, Nov. 1998.
York, "Millennium, YIA Single-Effect Absorption Chillers, Steam and Hot Water Chillers", 1997, York, Pennsylvania.

* cited by examiner

*Primary Examiner*—Mohammad M Ali
(74) *Attorney, Agent, or Firm*—McNees Wallace & Nurick LLC

(57) ABSTRACT

An absorption system includes a generator, a condenser, an evaporator, and an absorber configured to circulate a solution of an absorber and a refrigerant. A purge system removes a non-condensable gas from the absorber. The purge system includes a first pump to remove the solution from the absorber, a connection to remove the refrigerant vapor and the non-condensable gas from a low pressure region of the absorption system, an eductor to receive and mix the solution, a separator to receive the solution and remove the non-condensable gas from it, a tank to receive the non-condensable gas from the separator, a controller to monitor a pressure level of the tank, and a second pump to remove the non-condensable gas from the tank in response to the monitored pressure level in the tank being greater than a predetermined pressure level.

20 Claims, 4 Drawing Sheets

ABSORPTION SYSTEM

BACKGROUND

The application relates generally to absorption systems. More specifically, the application relates to an automatic purge system used in an absorption system.

Absorption systems may include an absorber, one or more pumps, one or more generators, a condenser, an evaporator, and associated piping and controls. The systems use a fluid that includes absorber or absorbent and refrigerant. The fluid is labeled either strong or dilute, depending on whether the concentration of absorber is relatively high or low. A dilute fluid may contain approximately 56-60 weight percent absorber, for example, lithium bromide. A strong fluid may contain approximately 59-65 weight percent absorber. The exact values depend upon operating temperatures and the design of the absorption system.

During operation of an absorption system, a dilute fluid exits or is pumped from an absorber to a generator, which evaporates refrigerant from the dilute fluid. Since evaporating the refrigerant from the dilute fluid increases the concentration of absorber in the fluid, the fluid is now referred to as a strong fluid. The strong fluid from the generator is returned to the absorber.

The evaporated or vapor refrigerant from the generator condenses to a condensed or liquid refrigerant in a condenser and then flows to an evaporator. In the evaporator, the condensed refrigerant absorbs ambient heat from a process fluid, which provides the desired refrigeration effect, and causes the refrigerant to vaporize.

The vaporized refrigerant from the evaporator flows to the absorber, where the refrigerant is exposed to the strong fluid returning from the generator. The strong fluid absorbs the refrigerant, thereby causing the strong fluid to become a dilute fluid and the process repeats.

Absorption systems may be large systems having complex constructions with many components. In absorption systems there may exist many joints between the components, which may provide the potential for the leakage of air into to the absorption system. Because the operating pressure of absorption systems may be very low, for example less than about six torr, there is an opportunity for the leakage of air into the system to occur. Introduction of air into an absorption system may cause a depletion of corrosion inhibiting chemicals within the absorption system and eventually, may cause internal corrosion, which may lead to a reduction in the performance of the absorption system. In addition, corrosion in the absorption system may produce non-condensable gases that may also cause a reduction in performance of the absorption system. A purge system can be used to remove air and non-condensable gases from the absorption system. A purge system may require an operator or user to frequently monitor the absorption system during operation to determine whether a purge of the air and non-condensable gases is necessary for proper operation of the absorption system.

SUMMARY

The present invention is directed to an absorption system including a generator, a condenser, an evaporator, and an absorber configured to circulate a solution of an absorber material and a refrigerant. The absorber is configured to contain the solution, a refrigerant vapor and a non-condensable gas. The absorption system further includes a purge system to remove the non-condensable gas from the absorber. The purge system includes a first pump configured to remove the refrigerant vapor and the non-condensable gas from the absorber, a separator configured to receive the refrigerant vapor and the non-condensable gas from the first pump, the separator being configured to separate the refrigerant vapor from the non-condensable gas, a tank configured to receive the non-condensable gas from the separator, a controller configured to monitor a pressure level of the tank, and a second pump configured to remove the non-condensable gas from the tank in response to the monitored pressure level being greater than a predetermined pressure level.

The present invention is also directed to a system to remove non-condensable gas from an absorption system including a first pump connectable to an absorber of an absorption system, the first pump configured to remove a solution, a refrigerant vapor and a non-condensable gas from the absorber, a separator in fluid communication with the first pump, the separator configured to separate the non-condensable gas from the solution and the refrigerant vapor, a tank in fluid communication with the separator, the tank configured to receive the non-condensable gas from the separator, a controller configured to monitor a pressure level in the tank, and a second pump in fluid communication with the tank, the second pump configured to remove the non-condensable gas from the tank in response to the monitored pressure level being greater than a predetermined pressure level.

The present invention is further directed to a method for purging non-condensable gas from an absorption system including removing a solution, a refrigerant vapor and a non-condensable gas from the absorber with a first pump, separating the non-condensable gas from the solution and the refrigerant vapor in a separator, storing the non-condensable gas from the separator in a tank, monitoring a pressure level in the tank, and removing the non-condensable gas from the tank in response to the monitored pressure level being greater than a predetermined pressure level.

DETAILED DESCRIPTION OF THE EXEMPLARY EMBODIMENTS

Figure 1:
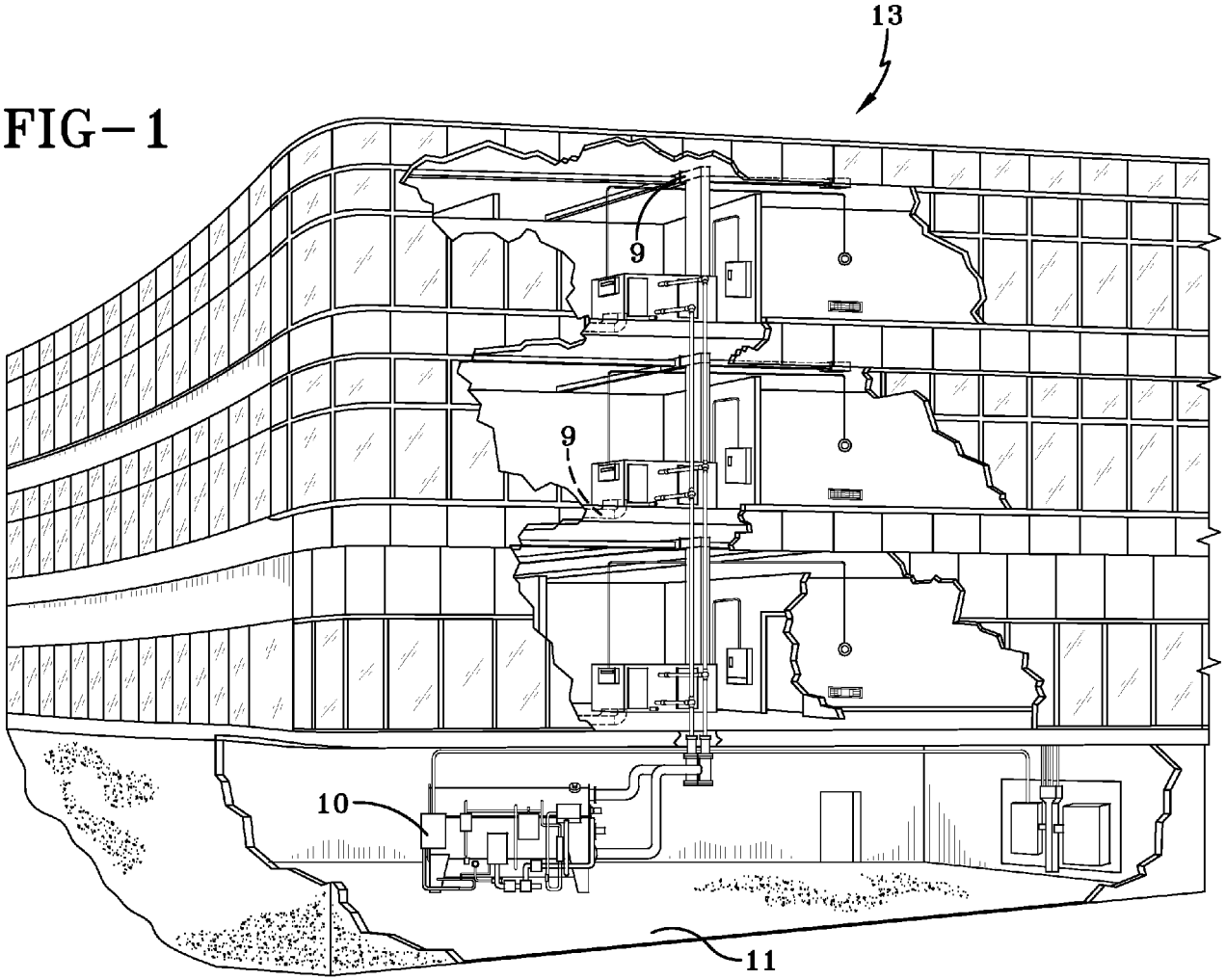
FIG. 1 shows an exemplary embodiment of an absorption system in a commercial building.

FIG. 1 shows absorption system 10 disposed in a commercial building 13. Absorption system 10, also known as an absorption chiller, can be located in an equipment room 11 in the basement of building 13. Absorption system 10 may also be located outside of building 13 in an enclosed space (not shown). A chilled liquid, for example, water, refrigerant or other suitable fluid can be provided by absorption system 10 to an air handling unit 9 that uses the chilled liquid to cool building 13. Air handling unit 9 then returns the liquid, which is warm, to absorption system 10 to repeat the process.

Figure 2:
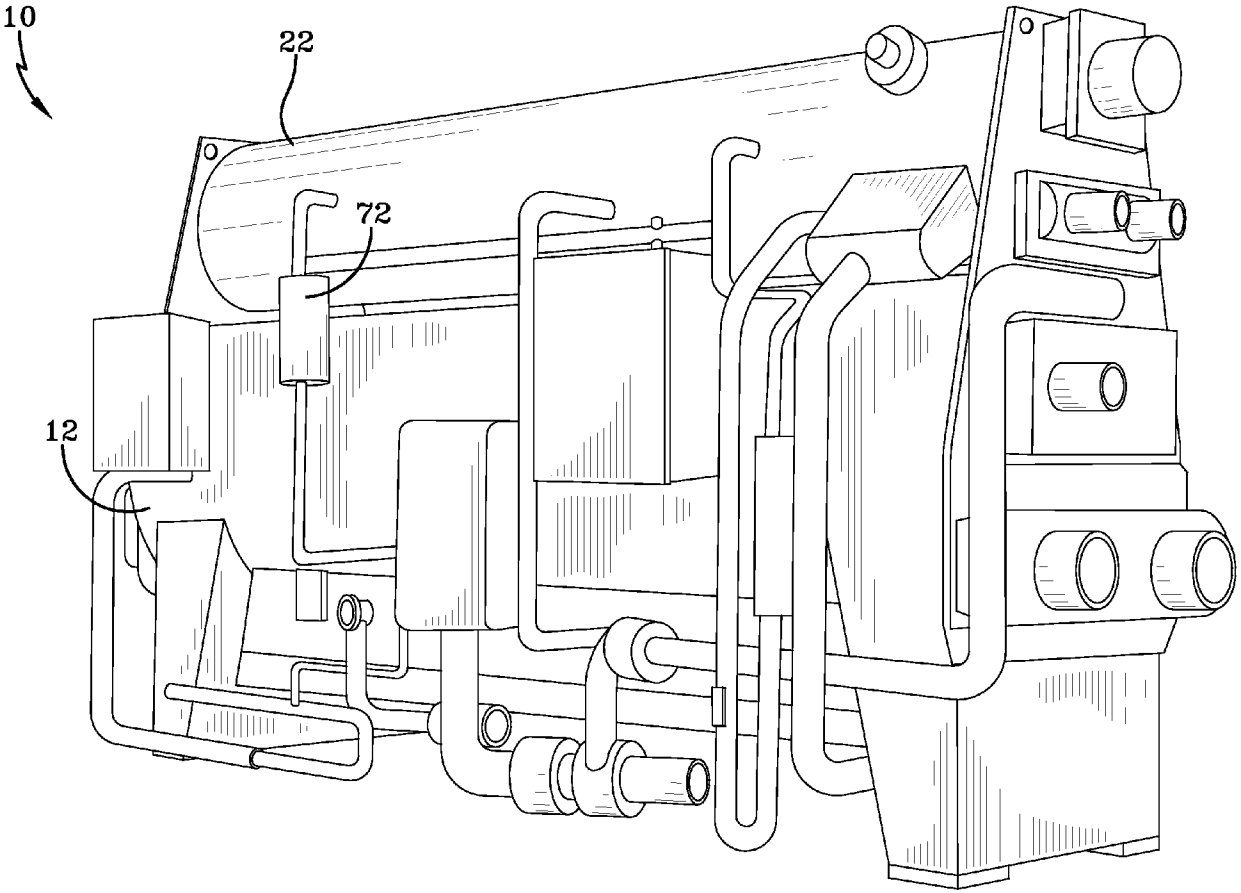
FIG. 2 shows an exemplary embodiment of an absorption system.

FIG. 2 shows an exemplary absorption system that may be used in commercial building 13 of FIG. 1. Absorption system 10 includes a first shell 12 and a second shell 22. First shell 12 houses an evaporator and an absorber. First shell 12 can operate at an internal pressure of about one one-hundredth (0.01) that of atmospheric pressure. The lower pressure level inside first shell 12 allows the refrigerant, for example, water, to boil at a temperature lower than the refrigerant's boiling point at atmospheric pressure. Second shell 22 contains a generator and condenser. Second shell 22 has an internal pressure of about one-tenth (0.1) of atmospheric pressure. Absorption system 10 may include four heat exchange processes including evaporation, absorption, generation and condensation. A fluid, or solution, of an absorber and a refrigerant, for example, a lithium bromide (LiBr) and water solution can be used in absorption system 10. The solution may have different concentrations of absorber and refrigerant, varying from strong (for example, 59 to 65 weight percent) to dilute (for example, 56 to 60 weight percent), depending upon the particular heat exchange process within absorption system 10. Absorption system 10 can include a purge system 72 for removing non-condensable gas from absorption system 10. Purge system 72 can include a tank 76 for storing non-condensable gas, a separator 72 for removing non-condensable gas from the absorption fluid, and a pump 88 for circulating the non-condensable gas in purge system 72.

Figure 3:
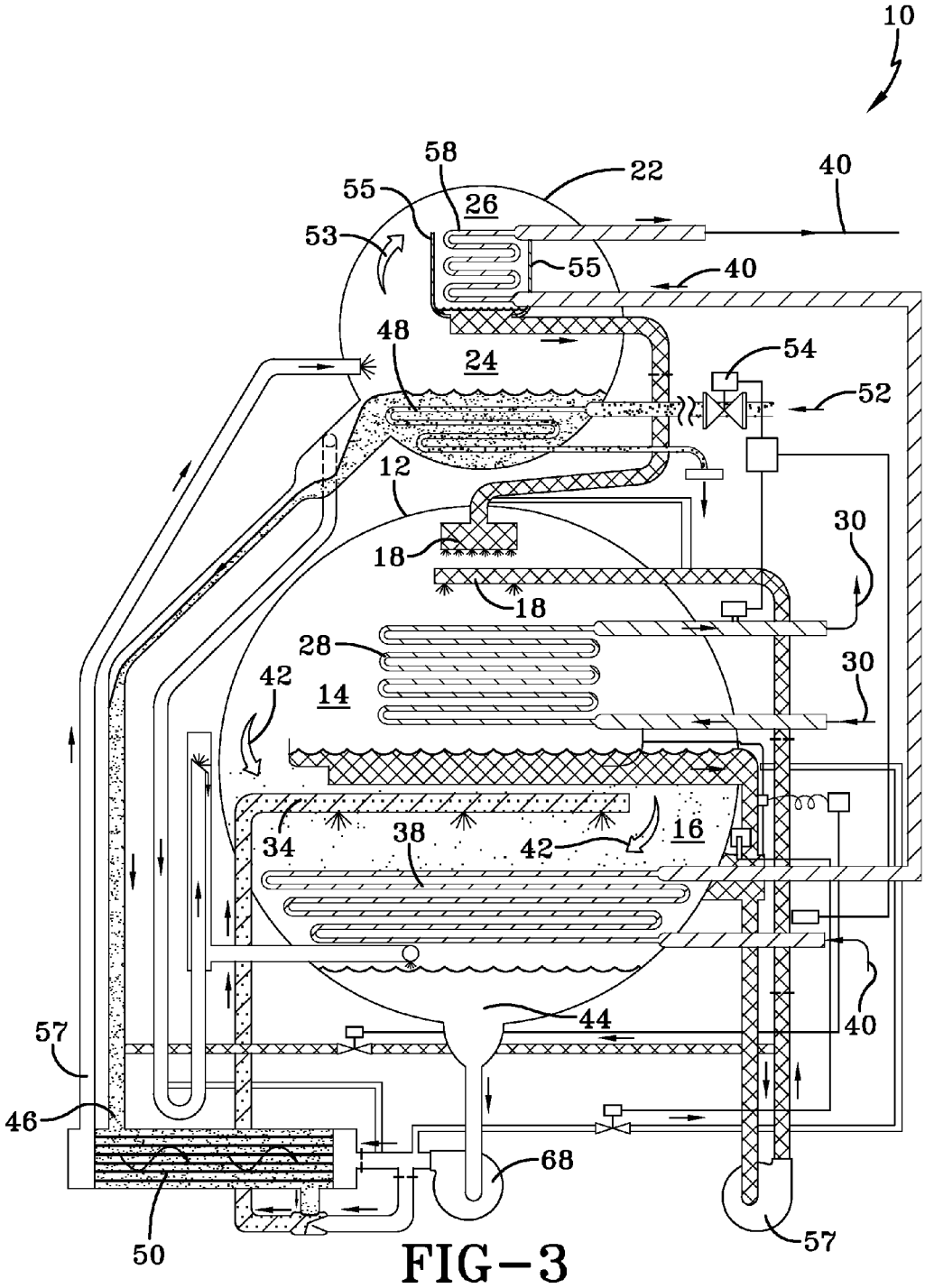
FIG. 3 schematically shows an exemplary embodiment of an absorption system.

As shown in FIG. 3, liquid refrigerant 18 enters evaporator 14 and is sprayed over evaporator tubes 28 to cool a liquid 30 flowing in evaporator tubes 28. Evaporator tubes 28 are shown as having multiple passes, although evaporator tubes 28 may be configured as a single pass. Liquid 30, for example, water, flows through evaporator tubes 28 and is cooled by the vaporization of liquid refrigerant 18. The vaporized refrigerant 42 travels into absorber 16. Any remaining liquid refrigerant 18 collects at the bottom of evaporator 14, where pump 57 returns liquid refrigerant 18 to evaporator 14 for distribution over evaporator tubes 28.

Vaporized refrigerant 42 flows from evaporator tubes 28 into absorber 16. In an alternate embodiment, vaporized refrigerant 42 from evaporator 14 may flow through baffles (not shown) before entering absorber 16. As vapor refrigerant 42 migrates over absorber tubes 38, an intermediate solution 34 from heat exchanger 50 is sprayed over absorber tubes 38. Cooling water 40 flows from a cooling tower (not shown) through absorber tubes 38. Tubes 38 can be arranged in a single pass or in multiple passes. Cooling water 40 is circulated through absorber 16 to cool intermediate solution 34 and the vaporized refrigerant. In absorber 16, intermediate solution 34, a solution at an intermediate concentration of absorber, for example, between a strong solution and a dilute solution, absorbs at least a portion of vaporized refrigerant 42 to become dilute solution 44. Dilute solution 44 collects at the bottom of absorber 16 from where it is pumped by a pump 68 through heat exchanger 50. A first portion of the dilute solution 44 from pump 68 is mixed with concentrated solution 46 from generator 24 in heat exchanger 50 to form intermediate solution 34 to be used in absorber 16.

A second portion of 57 dilute solution 44 from pump 68 is circulated in heat exchanger 50 undergoes a heat transfer process with concentrated solution 46. The second portion 57 is heated by concentrated solution 46. Second portion or stream 57 flows from heat exchanger 50 into second shell 22, and into generator 24. In generator 24, second stream 57 is sprayed over generator tubes 48 that are carrying heated fluid 52, for example, water, from any suitable source (for example, liquid 30). Heated fluid 52 in tubes 48 heats second stream 57, creating vapor refrigerant 53, which migrates into condenser 26, and concentrated solution 46, which flows to heat exchanger 50. The temperature of heated fluid 52 can be variably controlled by valve 54 in response to the desired cooling load. Vapor refrigerant 53 can pass through mist eliminators 55, or baffles, to remove at least a portion of liquid refrigerant that can be entrained in vapor refrigerant 53 before entering condenser 26. Vapor refrigerant 53 passes over condenser tubes 58, in which cooling water 40 from absorber 16 flows and is then returned to a cooling tower (not shown). Vapor refrigerant 53 condenses on tubes 58, and then collects at the bottom of condenser 26 as liquid refrigerant 18. Liquid refrigerant 18 is directed back to first shell 12 and into evaporator 14, where the cooling cycle of absorption system 10 is repeated. During the absorption system process, non-condensable gas may form or collect within absorption system 10, particularly in absorber 16, and may decrease the performance of absorption system 10. A purge system 72 can be used to remove the non-condensable gas from absorption system 10.

Figure 4:
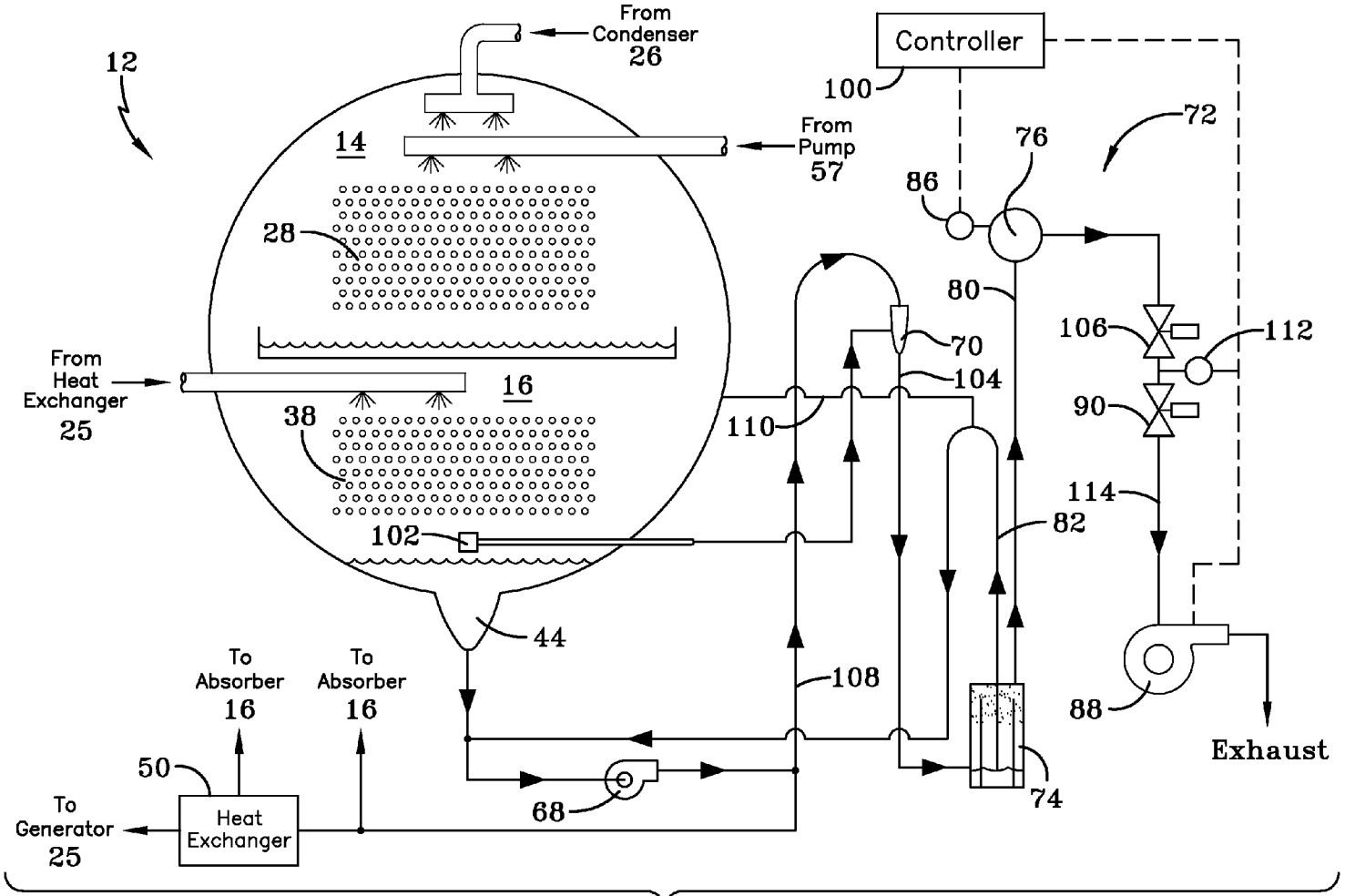
FIG. 4 schematically shows an exemplary embodiment of an automatic purge system for an absorption system.

As illustrated schematically in FIG. 4, purge system 72 removes vapor from absorber 16, and more specifically, removes non-condensable gas from absorber 16 and absorption system 10. Purge system 72 may operate automatically without the intervention of an operator with the use of a controller 100, pump 88, valve 90 and valve 106. Purge system 72 monitors and tracks data related to the pressure level and rate of pressure change in purge system 72 and automatically expels the non-condensable gases that have collected in absorption system 10.

A connection 102 shown just above the level of liquid 44 of absorber 16 removes vapor refrigerant 42 and at least a portion of non-condensable gas present in absorber 16 into purge system 72 using dilute solution 44 as an eductor motive fluid. The connection 102 can be positioned in a low pressure region of absorption system 10, for example, absorber 16, because the non-condensable gas can be concentrated in the low pressure region of absorption system 10. As used herein the term "low pressure region" refers to a portion of absorption system 10 having a lower pressure than another portion of absorption system 10 and having a higher concentration of non-condensable gas than another portion of absorption system 10. Such positioning of connection 102 may reduce or eliminate the desire for including additional pumps. The positioning of connection 102 can further be based upon other physical factors such as gravity.

Dilute solution 44 is removed from absorber 16 by pump 68 and flows to eductor 70 through line 108. The vapor removed from absorber 16 may include, but is not limited to refrigerant vapor, solution vapor, external air, and non-condensable gas. Vapor refrigerant 42 is absorbed and non-condensable gas is entrained into dilute solution 44 in the eductor outlet flow stream 104. The motive fluid entrained with vapor refrigerant and non-condensable gas flows to a separator 74 where the non-condensable gas is removed from the motive fluid by baffles allowing the buoyant gas to rise from the fluid and then be sent to a tank 76. The refrigerant vapor absorbed into the motive fluid remains part of the solution. A standing column of motive fluid in outlet line 80 traps the non-condensable gas in tank 76. The standing column of the motive fluid in outlet line 80 is maintained by an operating pressure range controlled by a vented inverted trap 82 in a second outlet from separator 74. Vented inverted trap 82 operates similar to a manometer. Dilute solution 44 flows through vented inverted trap 82 to pump 68 and then to either eductor 70, spray connection 34, or to Heat Exchanger 50. Vent line 110 allows inverted trap line 82 and separator 74 to maintain the same pressure level as the pressure in absorber 16, thereby maintaining the standing column of fluid in outlet line 80.

A sensor 86 monitors the pressure level in tank 76 and transmits a signal to a controller 100. The pressure level may be a static pressure point or may be a rate of pressure change. The signal may indicate whether the pressure level of the tank is greater than a predetermined pressure level and/or whether the rate of change of the pressure level of the tank is greater than a predetermined rate of change of the pressure level. When the pressure level of tank 76 rises to a predetermined level, controller 100 signals a valve 106, valve 90, and a pump 88 to initiate purge system 72. Pump 88 expels at least a portion of non-condensable gas from tank 76, thereby expelling at least a portion of non-condensable gas from absorption system 10. When the pressure level in tank 76 equals a predetermined pressure level, controller 100 opens valve 90 and starts pump 88. Pump 88 begins to exhaust at least a portion of non-condensable gas in line 114. Sensor 112 monitors the pressure level in line 114, and when the pressure level in line 114 between valve 106 and valve 90 is substantially a vacuum, sensor 112 signals controller 100.

Lowering the pressure level in line 114 is performed to initiate flow in the proper direction out of tank 76 because initial purge system 72 and tank 76 operate under a substantial vacuum. Controller 100 then opens valve 106 and pump 88 exhausts at least a portion of non-condensable gas from tank 76, thereby removing at least a portion of non-condensable gas from absorption system 10.

Controller 100 may be a microprocessor or any other suitable type of control device. Controller 100 may also include a program that tracks data trends. Data may include the rate of pressure increase in tank 76 over predetermined time intervals. Data stored by controller 100 can be used and evaluated for troubleshooting purposes to determine if leaks have formed in absorption system 10. For example, if the pressure level in tank 76 increases rapidly after non-condensable gasses 66 have been purged from tank 76, the rapid pressure increase may indicate that there is a leak or multiple leaks in absorption system 10.

While only certain features and embodiments of the invention have been illustrated and described, many modifications and changes may occur to those skilled in the art (for example, variations in sizes, dimensions, structures, shapes and proportions of the various elements, values of parameters, such as temperatures, pressures, etc., mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (for example, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An absorption system, comprising:

a generator, a condenser, an evaporator, and an absorber configured to circulate a solution of an absorber material and a refrigerant;

the absorber configured to contain the solution, a refrigerant vapor, and a non-condensable gas; and a purge system to remove the non-condensable gas from the absorber, the purge system comprising:

a first pump configured to remove the solution from the absorber;

a connection configured to remove the refrigerant vapor and the non-condensable gas from a low pressure region of the absorption system;

an eductor configured to receive and mix the solution removed by the first pump and the refrigerant vapor and the non-condensable gas removed by the connection;

a separator configured to receive the solution, the refrigerant vapor, and the non-condensable gas from the eductor, the separator being configured to remove the non-condensable gas from the solution and the refrigerant vapor;

a tank configured to receive the non-condensable gas from the separator;

a controller configured to monitor a pressure level of the tank; and a second pump configured to remove the non-condensable gas from the tank in response to the monitored pressure level being greater than a predetermined pressure level.

2. The absorption system of claim 1, wherein the eductor is driven by the solution and wherein the solution absorbs the refrigerant vapor and entrains the non-condensable gas removed by the eductor to form a second solution.

3. The absorption system of claim 2, wherein the separator removes the non-condensable gas from the second solution and discharges the non-condensable gas to the tank.

4. The absorption system of claim 1, wherein the purge system comprises a first sensor, the first sensor monitors the pressure level of the tank, and the first sensor transmits a signal to the controller, the signal indicating whether the pressure level of the tank is greater than a predetermined pressure level.

5. The absorption system of claim 4, wherein the purge system comprises a line connecting the second pump and tank and a first valve positioned in the line, the first valve configured to open and the second pump configured to expel the non-condensable gas in response the controller receiving the signal.

6. The absorption system of claim 5, wherein the purge system comprises a second valve disposed in the line and a second sensor, the second sensor configured to monitor the pressure level between the first valve and the second valve, the second valve configured to open in response to the second sensor detecting substantially a vacuum.

7. The absorption system of claim 1, wherein the purge system comprises a first sensor, the first sensor monitors the rate of change of the pressure level of the tank, and the first sensor transmits a signal to the controller, the signal indicating whether the rate of change of the pressure level of the tank is greater than a predetermined rate of change of the pressure level.

8. The absorption system of claim 1, wherein the connection is positioned just above the level of liquid in the absorber.

9. A system to remove non-condensable gas from an absorption system, the system comprising:

a first pump connectable to an absorber of an absorption system, the first pump configured to remove a solution from the absorber;

a connection configured to remove the refrigerant vapor and the non-condensable gas from a low pressure region of the absorption system;

an eductor configured to receive and mix the solution removed by the first pump and the refrigerant vapor and the non-condensable gas removed by the connection;

a separator configured to receive the solution, the refrigerant vapor, and the non-condensable gas from the eductor, the separator being configured to remove the non-condensable gas from the solution and the refrigerant vapor;

a tank in fluid communication with the separator, the tank configured to receive the non-condensable gas from the separator;

a controller configured to monitor a pressure level in the tank; and a second pump in fluid communication with the tank, the second pump configured to remove the non-condensable gas from the tank in response to the monitored pressure level being greater than a predetermined pressure level.

10. The system of claim 9, wherein the solution removed by the first pump and the refrigerant vapor and the non-condensable gas removed by the connection all flow to an eductor.

11. The system of claim 10, wherein the eductor is driven by the solution and wherein the solution absorbs the refrigerant vapor and entrains the non-condensable gas removed by the eductor to form a second solution.

12. The system of claim 11, wherein the separator removes the non-condensable gas from the second solution and discharges the non-condensable gas to the tank.

13. The system of claim 9, wherein the system comprises a first sensor, the first sensor monitors the pressure level of the tank, and the first sensor transmits a signal to the controller, the signal indicating whether the pressure level of the tank is greater than a predetermined pressure level.

14. The system of claim 13, wherein the system comprises a line connecting the second pump and tank and a first valve positioned in the line, the first valve configured to open and the second pump configured to expel the non-condensable gas in response the controller receiving the signal.

15. The system of claim 14, wherein the system comprises a second valve disposed in the line and a second sensor, the second sensor configured to monitor the pressure level between the first valve and the second valve, the second valve configured to open in response to the second sensor detecting substantially a vacuum.

16. A method for purging non-condensable gas from an absorption system comprising:

removing a solution from the absorber;

removing a refrigerant vapor and a non-condensable gas from a low pressure region of the absorption system;

receiving and mixing the solution, the refrigerant vapor, and the non-condensable gas;

removing the non-condensable gas from the solution and the refrigerant vapor;

directing the non-condensable gas from the solution to a tank;

monitoring a pressure level in the tank; and removing the non-condensable gas from the tank in response to the monitored pressure level being greater than to a predetermined pressure level.

17. The method of claim 16, wherein the step of removing the solution and the step of removing the refrigerant vapor and the non-condensable gas from the low pressure region of the absorption system with the connection are separately performed through two lines connected to an eductor.

18. The method of claim 16, further comprising forming a vacuum in the tank.

19. The method of claim 18, further comprising automatically opening a first valve to permit flow of non-condensable gas.

20. The method of claim 16, further comprising storing of data on the pressure level and rate of pressure change in the tank for a predetermined amount of time.

* * * * *